US005612519A

United States Patent [19]

Chenais

[11] Patent Number: 5,612,519

[45] Date of Patent: Mar. 18, 1997

[54] METHOD AND APPARATUS FOR ASSIGNING CALLS ENTERED AT FLOORS TO CARS OF A GROUP OF ELEVATORS

[75] Inventor: Patrick Chenais, Ebikon, Switzerland

[73] Assignee: Inventio AG, Hergiswil, Switzerland

[21] Appl. No.: 296,008

[22] Filed: Aug. 25, 1994

Related U.S. Application Data

[63] Continuation-in-part of Ser. No. 48,269, Apr. 14, 1993, abandoned.

[30] Foreign Application Priority Data

Apr. 14, 1992 [CH] Switzerland ..... 01242/92

[51] Int. Cl.[6] ..... B66B 1/18

[52] U.S. Cl. ..... 187/382; 187/380; 187/387

[58] Field of Search ..... 187/380, 381, 187/382, 384, 387

[56] References Cited

U.S. PATENT DOCUMENTS 4,815,568 3/1989 Bittar ..... 187/127

5,146,053 9/1992 Powell et al. ..... 187/127

5,260,526 11/1993 Siraig, Jr. ..... 187/127

5,503,249 4/1996 Virtamo et al. ..... 187/382

*Primary Examiner*—Robert Nappi

*Attorney, Agent, or Firm*—Howard & Howard

[57] ABSTRACT

A group elevator control includes a call allocation device which automatically adapts to optimization criteria and traffic conditions so that an optimum call assignment is achieved. The device includes a solution selection module which calculates starting from a first time predetermined solution, further possible solutions for the call assignment which are fed to a simulator module. A traffic model module supplies possible passenger number and destination floor data to the simulator from which is generated factors data for the solutions, the factors data relating to passengers and/or elevator components. The factors data is fed to a calculation module, which uses a calculation function and optimization criteria data from the elevator control to generate another call allocation solution to the solution selection module which compares each another call allocation solution with the previous best solution to select the best of all possible solutions for the call allocation.

13 Claims, 3 Drawing Sheets

METHOD AND APPARATUS FOR ASSIGNING CALLS ENTERED AT FLOORS TO CARS OF A GROUP OF ELEVATORS

This is a continuation-in-part of application Ser. No. 08/048,269 filed on Apr. 14, 1993, now abandoned.

BACKGROUND OF THE INVENTION

The present invention relates generally to elevator controls and, in particular, to a method and an apparatus for assigning hall calls to a group of elevators.

There is shown in the European patent document EP-B 0 032 213 (corresponding to the U.S. Pat. No. 4,355,705) and in the European patent document EP-AA 0 356 731 (corresponding to the U.S. Pat. No. 4,991,694), for example, elevator group controls in which the intermediate floor calls are immediately assigned. These controls calculate, using a mathematical formula, a value called the cost of servicing or the operating cost corresponding to the waiting time of the passengers. This calculation is mainly based on the waiting time of the passengers on the floors as well as in the cars during an intermediate stop and the traveling time of the passengers in the cars. The operating costs are determined for every elevator of the group and are compared with each other, where the entered call is assigned to that car which exhibits the lowest cost. In this manner, the average waiting time of all passengers is minimized. In this type of elevator control, the well defined operational objective of minimizing the average waiting time is taken as the basis for the calculation formula. For attaining a different operational objective, as for example the minimization of long waiting times, these types of controls are not suitable.

Elevator group controls of the type described above are often used with elevator installations for the control of DOWN-peak and/or UP-peak traffic, as described for example in the German patent document DE-A 18 03 648 or in the European patent document EP-B 0 091 554 (corresponding to the U.S. Pat. No. 4,492,288). Elevator controls of this type make it possible to empty a building in relatively short time in case of extreme collective traffic incidence in the direction of a main floor, for example, at the end of the workday in an office building. In this case, the peak traffic portion of the control can be activated by a switch clock or by a measuring device determining the traffic flow in direction of the main floor, wherein at the same time the servicing of calls in the UP-direction can be reduced or completely eliminated. The control algorithm or calculation formula is based upon minimizing the waiting time of the passengers as well as increasing the transport capacity of the elevator group.

Until the above discussed switch clock or measuring device determining the traffic flow becomes active, a considerable time interval can occur during which not only the interfloor traffic but also the DOWN-peak traffic has to be serviced. This case can occur, for example, at the start of the lunch hour, at the closing hour of the office or through a sudden increase in the traffic at the end of a conference at one or several intermediate floors. In this case, few passengers occupy cars for upward travel so that the many passengers who want to travel downward are subjected to intolerably long waiting times. Besides, the transport capacity of the elevator group is under utilized in such a case.

SUMMARY OF THE INVENTION

The present invention concerns an apparatus and a method for the assignment of calls entered at the floors to cars of a group of elevators, wherein solutions are computed by means of a calculation function and the best solution is applied.

The calls are distributed to the cars according to specific optimization criteria by means of the calculation function where operational objectives, for example a minimum average waiting time of all passengers or the highest possible transport capacity, can be taken as a basis. A further important aspect in the assignment of calls are the prevailing traffic conditions, wherein three independent traffic categories must be distinguished, that is, intermediate floor traffic, UP-peak traffic and DOWN-peak traffic.

The apparatus according to the present invention is a hall call allocation device having a solution selection module which computes possible call allocation solutions starting from a first time solution according to predetermined conventional rules and current situation data for the group of elevators. The first time solution and other possible solutions are generated in sequence as a probable best call allocation solution to a simulator module which uses data from a traffic model module representing probable numbers of passengers and possible floor destinations for the entered calls to generate factors data for passengers and/or elevator components. A calculation module uses a calculation function to evaluate the factors data and optimization criteria data from a group elevator control to generate another call allocation solution corresponding to the optimization criteria and the current traffic conditions in the elevator group. The another solution is sent to the solution selection module which checks to see if it is the best solution for the call allocation. If the another solution is better than the previous best solution, it is checked for future situations and stored as the best solution if acceptable. The possible solutions are generated and evaluated until all possible solutions have been evaluated, or the time available for allocation has elapsed, or the current situation data changes.

The advantages realized with the present invention are that the elevator control is automatically matched to the existing operational objectives, optimization criteria, and changes in the traffic conditions. The optimization criteria contained in the calculation module can be modified simply and rapidly, which has an advantageous effect in case of special requirements of the operator of the elevator installation.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
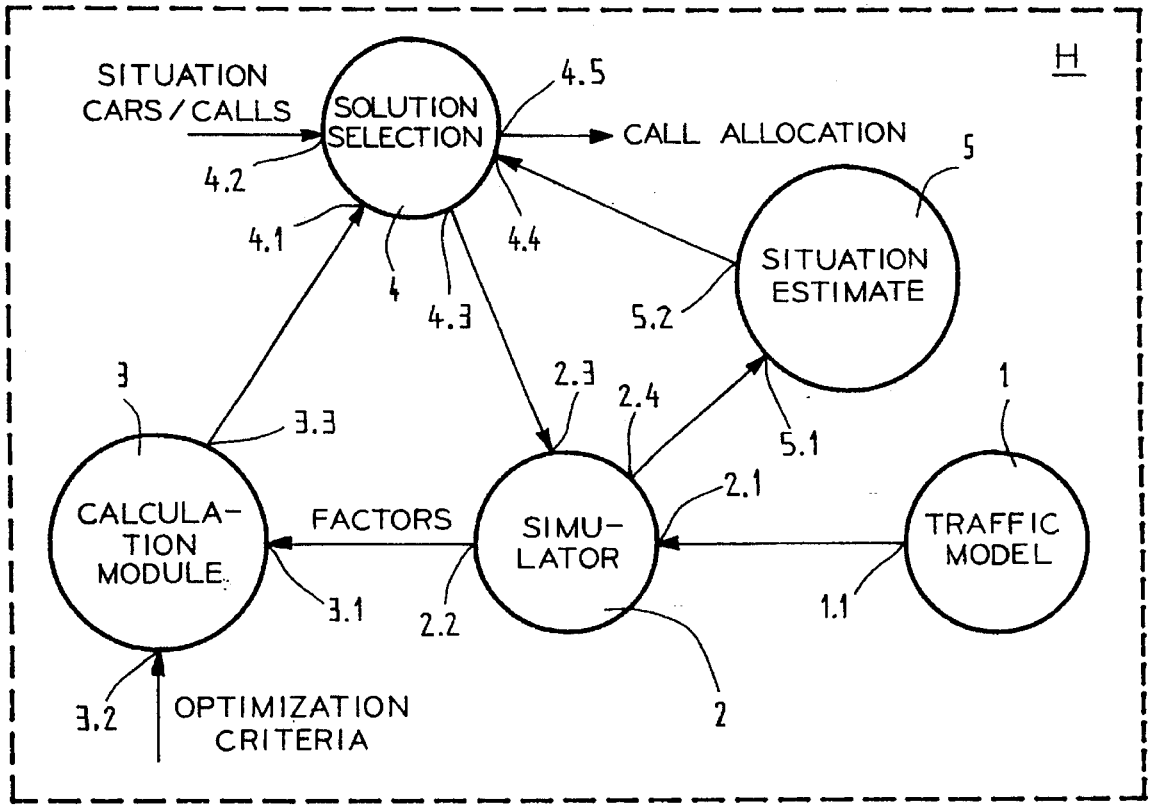
FIG. 1 is a block diagram of an apparatus according to the present invention for assigning hall calls utilizing the method according to the present invention.

Designated H in the FIG. 1 is a hall call assignment device for assigning each of a plurality of hall calls entered at floors served by a group of elevators to the elevator car best able to serve that hall call in accordance with the method according to the present invention. The assignment device H can be implemented in an associated group elevator control as hard wired logic devices or a software program in a general purpose computer. The assignment device H includes a traffic model module 1 which generates passenger dam as output signals at an output 1.1 connected to a first input 2.1 of a simulator module 2. The simulator module 2 generates factors related to passengers and/or elevator components as factors data signals at an output 2.2. The output 2.2 is connected to a first input 3.1 of a calculation module 3 which module has a second input 3.2 connected to an interface (not shown) in the elevator control by which optimization criteria data can be inputted as optimization criteria data signals. An output 3.3 of the calculation module 3 is connected to a first input 4.1 of a solution selection module 4. A second input 4.2 of the module is connected to a source of situation data (not shown) in the associated elevator control representing the momentary situation of the cars and the entered calls as current situation data signals. The solution selection module 4 has an output 4.3 connected to a second input 2.3 of the simulator module 2. A situation estimate module 5 has an input 5.1 connected to a second output 2.4 of the simulator module 2 and an output 5.2 connected to a third input 4.4 of the solution selection module 4. The solution selection module 4 has a second output 4.5 connected to the associated elevator control (not shown) for generating call allocation data signals. The hall call allocation device H can be implemented as a software program in an elevator control computer such as the elevator control shown in the U.S. Pat. No. 4,991,694.

Figure 2:
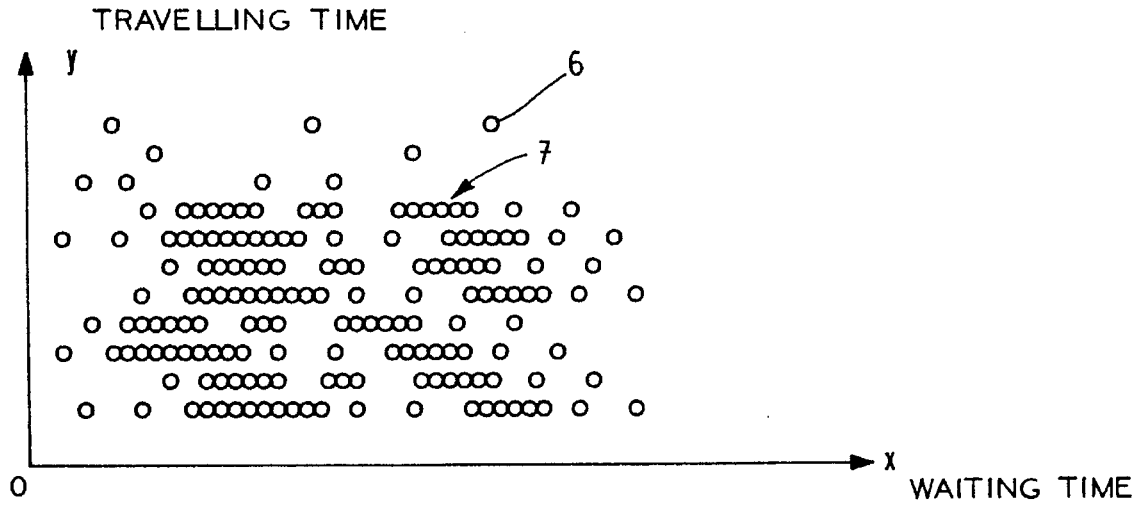
FIG. 2 is a diagram of the distribution of waiting times versus travelling times of passengers.

There is shown in the FIG. 2 a plot of a traffic model representing the distribution of passengers entering floor calls and the related waiting times and travelling times. An x-axis represents values of waiting time and a y-axis represents values of the associated travelling time of passengers for a group of elevators. Each of the passengers is represented by a circle or point 6 located in a two-dimensional factor space defining the waiting time and the associated travelling time data. The passenger data representing the probable number of passengers waiting at a floor and their probable travel destinations is stored the passenger data in the traffic model module 1 and is sent to the input 2.1 as output signals whereby the passenger related factors are determined in the simulator module 2. Derived from this distribution are data for the calculation, for example, of the traffic density which is proportional to the number of points. For the recognition and registration of a cluster shaped accumulation of points, for example a plurality of points 7, a neural network can be utilized which through a learning process is so adaptable that most different patterns can be recognized. If the factor computation requires factors which are related to elevator components, it is possible to apply the procedure described in the above, where for example, factors such as energy consumption and number of door openings can be projected into one factor space.

Figure 3A:
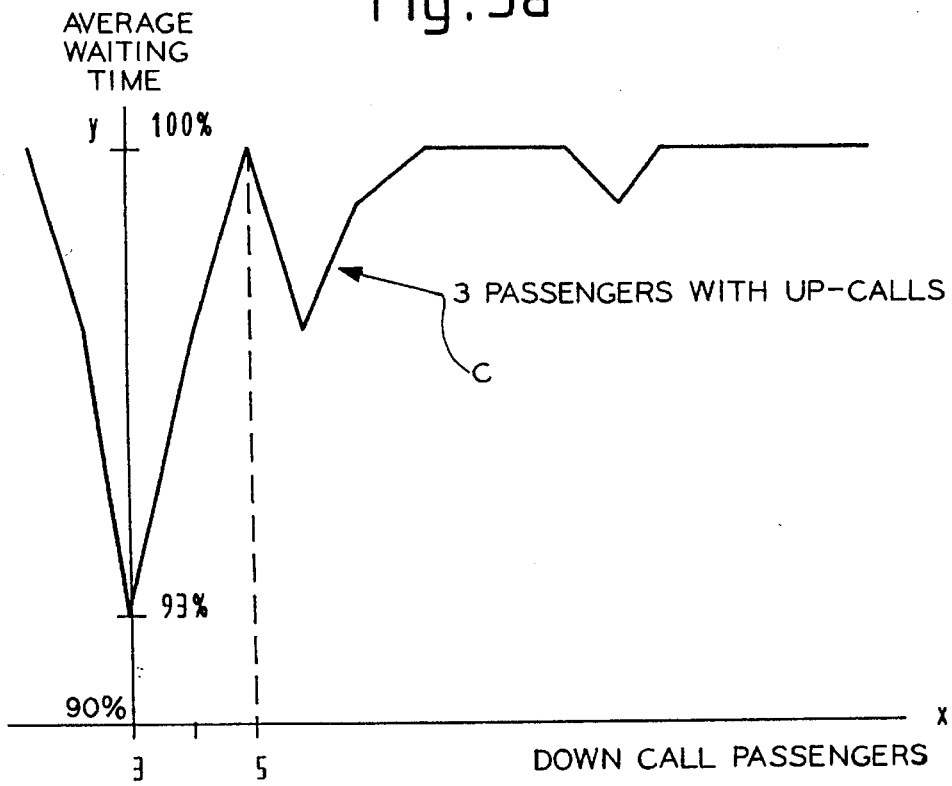
FIG. 3*a* is a diagram of the waiting time plotted as a function of the number of passengers during the transition from interfloor traffic to DOWN-peak traffic.
Figure 3B:
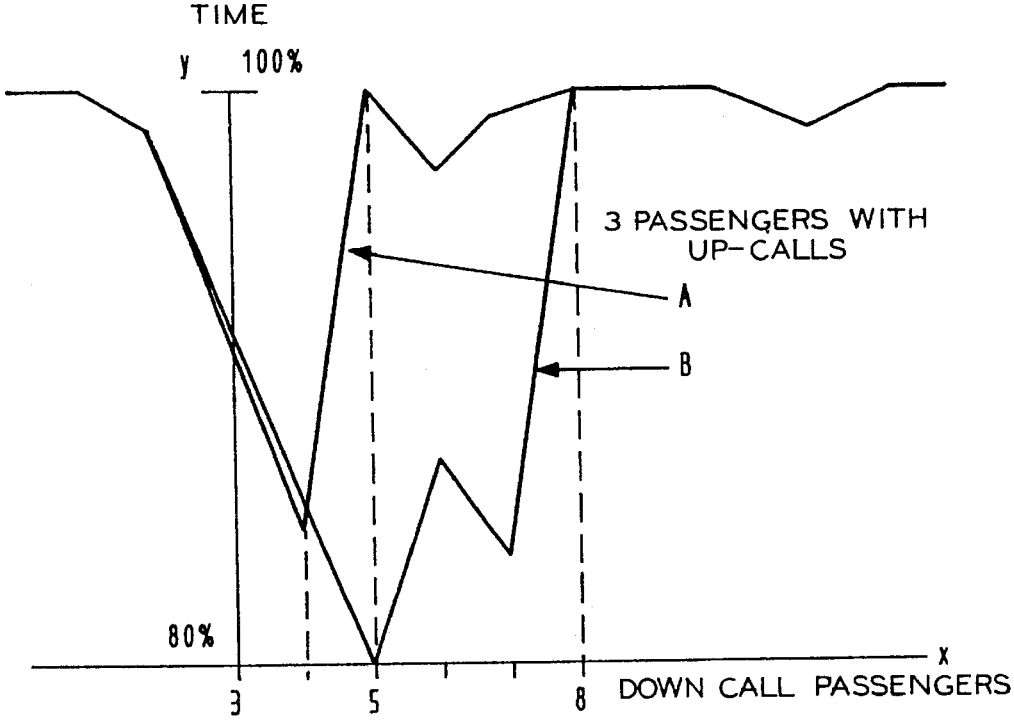
FIG. 3*b* is another diagram of the waiting time plotted as a function of the number of passengers during the transition from interfloor traffic to DOWN-peak traffic.

In the FIGS. 3*a* and 3*b*, there is shown a plot of the number of passengers who have entered DOWN-calls at the floors versus the average waiting time for the arrival of an elevator car which illustrates some advantages of the apparatus and method according to the present invention. An x-axis represents the number of passengers who have entered DOWN-calls and a y-axis represents the average waiting time where 100% corresponds to the average waiting time associated with standard or conventional elevator control devices. In the FIG. 3*a*, the x-axis crosses the y-axis at the 90% of standard time point and the y-axis crosses the x-axis at the three passengers with DOWN-calls point. Chosen as a reference in the FIG. 3*a* was the better interfloor traffic program or the better DOWN-peak traffic program respectively. In the presence of three passengers with UP-calls, a characteristic curve C shows an improvement in the average waiting time of a maximum of about 7% (93% versus 100%) at the three passengers with DOWN-calls point on the x-axis.

In the FIG. 3*b*, the x-axis crosses the y-axis at the 80% of standard time point and the y-axis crosses the x-axis at the three passengers with DOWN-calls point. The reference traffic program is automatically switched over when the number of passengers with DOWN-calls exceeds five (characteristic curve A) and eight (characteristic curve B). In the presence of three passengers with UP-calls, an improvement of up to 20% is achieved during the change of the traffic mode at the five passengers with DOWN-calls point as shown by the characteristic curve B.

The hall call assignment apparatus H described above operates in accordance with the method according to the present invention as follows:

Dependent on the situation data of the cars and the entered calls, which data is generated by the elevator control and is present at the input 4.2 shown in the FIG. 1 as the current situation data signals, and starting from a first time solution calculated according to predetermined conventional rules, possible solutions are determined for the call allocation in the solution selection module 4. For this purpose, for example, a method called "alpha pruning" can be employed. In this method, a "tree" is formed the branches of which are assigned to the cars and the calls to be served by the cars. Thus, the tree represents the possible solution call allocation being sought. A description of the method of "alpha pruning" is found in "Real-Time Heuristic Search: First Results" in the Proceedings of AAAI-87, Seattle, Wash., July 1987 and in "Search: A Survey of Recent Results" in "Exploring Artificial Intelligence", chapter 6, eds. H. E. Strobe, Morgan Kaufmann Publishers, Inc. 1988, both by Richard E. Korf. Alpha pruning is a technique used to solve gaming and transportation problems involving multiple combinations of moves or paths. The branches extend between moves or destinations. A cost is assigned to each branch and higher cost branches are "pruned off" of the tree to determine the least costly solution. In terms of elevator control, the branches extend between pairs of destination floors.

The search for a best solution is terminated if the situation data at the input 4.2 changes. The first solution is stored as a best solution in the solution selection module 4 and is fed to the simulator module 2 at the input 2.3 as a probable best call allocation solution signal. From the traffic module 1, the simulator module 2 again receives information about the probable number of passengers waiting at a floor where there is an entered call and estimates regarding their possible travel destinations in the form of the output signals. From this information, the simulator module 2 forms factors data (FIG. 2) representing the probable best solution. Optimization criteria data signals from the elevator control are generated at the input 3.2 and the optimization criteria is evaluated in the calculation module 3 by a calculation function using the factors data signals from the simulator module 2 so that a solution corresponding the optimization criteria and the traffic conditions is found. This solution is generated as another call allocation solution signals to the solution selection module 4 which checks against the best solution stored therein to determine whether this another solution is the best solution for the call allocation. If the another solution is better than the currently stored best solution, the solution selection module 4 stores the probable best call allocation solution as the best solution. Then another possible solution from the multitude of the possible solutions is generated as the probable best call allocation solution and the above described method is repeated.

Each time a new best solution is found and before it is stored, the situation estimate module 5 analyses the actual situation data of the cars and the calls with the aid of information from the simulator module 2 in the form of the probable best call allocation solution signals from the solution selection module 4 and the output signals from the traffic model module 1. The module 5 predicts therefrom the future situation data of the cars and the calls. If a new best solution found for the call allocation would lead to an extreme future situation, such as for example a group formation of cars (bunching), this new best solution will be discarded and a new best solution searched for.

The hall call assignment device H described above replaces that portion of a group elevator control which allocates hall calls. The hall call assignment device H is designed to operate with any type of elevator control and, therefore, must accept all of the situation data provided by the specific elevator control in which it operates in order to improve the performance of that elevator control. The device H accepts any and all situation data available and is not limited to any specific set of situation data in order to achieve the desired result of reducing passenger waiting times.

For example, the performance of the elevator control shown in the U.S. Pat. No. 4,991,694 can be optimized by connecting the input 4.2 of the solution selection module 4 (FIG. 1) to receive all of the situation data representing the current status of whatever prevailing traffic conditions are considered important to the allocation of hall calls by that elevator control. The set of situation data generated by that elevator control is fully set forth in the U.S. Pat. No. 4,991,694. Other types of elevator controls with which the device H can be used are shown in the U.S. Pat. No. 4,355,705 and the U.S. Pat. No. 4,492,288. These elevator controls use different sets of situation data which may include all or a portion of the situation data used by other elevator controls. Thus, it is not a specific set of situation data which causes optimized performance of the device H and the associated elevator control. Rather, in each case the same device H uses the situation data available from the selected elevator control to optimize the performance of that control.

The individual data elements of the set of situation data are used in accordance with practices well known in the elevator art. The device H is intended to operate to reduce the average waiting time of passengers. See the FIGS. 3*a* and 3*b* and the associated description above. Thus, the hall call assignment device H utilizes all of the situation data available to determine the waiting time of passengers. For example, the situation data representing the distance a car has to travel to serve a hall call would be used by the device H to determine the travel time of the car to the call just as any elevator control would use such situation data.

Figure 4:
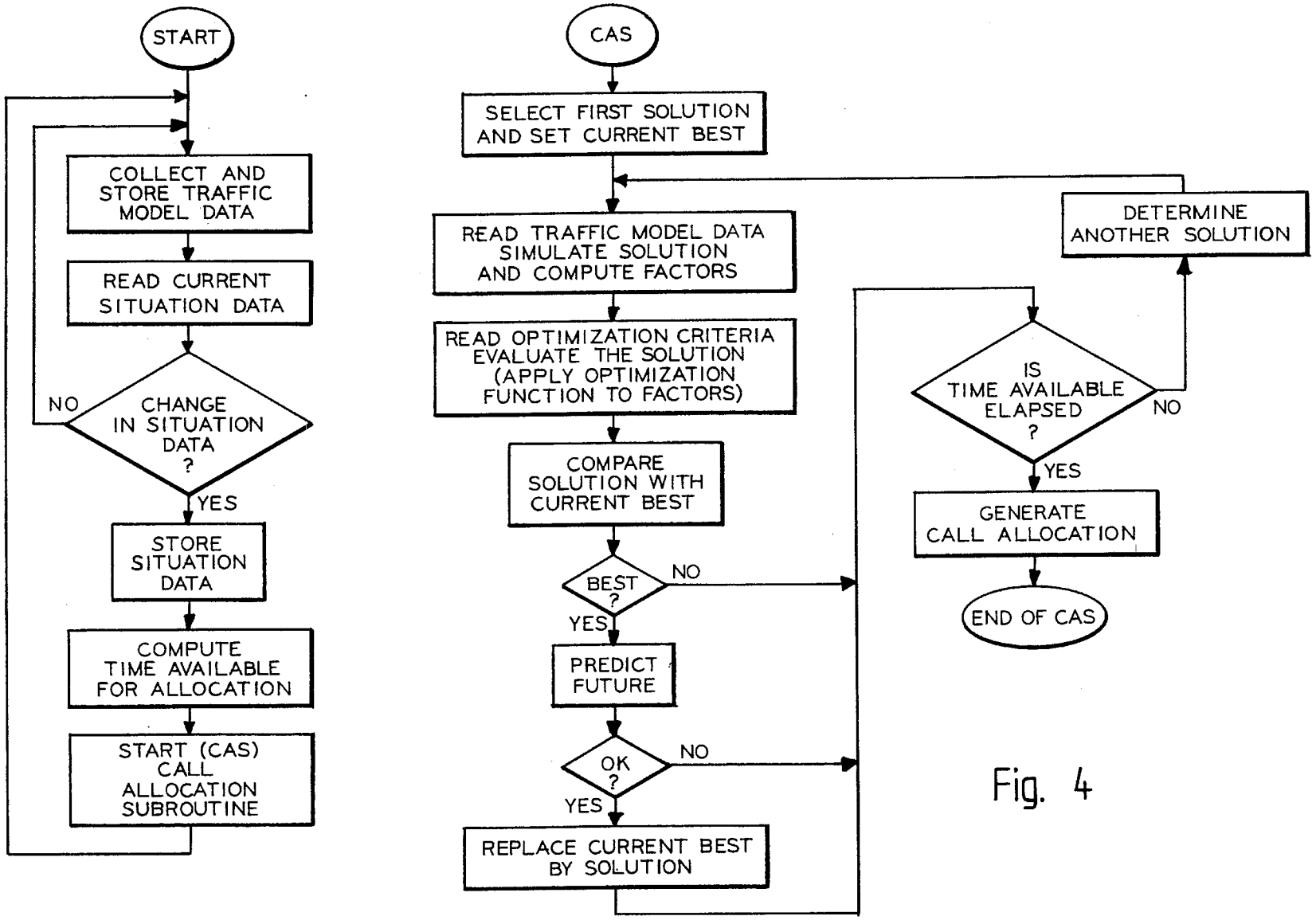
FIG. 4 is a flow diagram of the method for assigning hall calls according to the present invention.

There is shown in the FIG. 4 a flow chart of the method for assigning hall calls according to the present invention. The method begins at a circle "START" and enters an instruction "COLLECT AND STORE TRAFFIC MODEL DATA" wherein the data is stored in the traffic model module 1 of the FIG. 1. The method enters an instruction "READ CURRENT SITUATION DATA" wherein the data at the input 4.2 representing the current situation of the elevator cars and any entered hall calls and car calls is stored. A check is made at a decision point "CHANGE IN SITUATION DATA?" for any change since the last time the situation data was read. If no change occurred, the method branches at "NO" and returns to the instruction "COLLECT AND STORE TRAFFIC MODEL DATA". If a change occurred, the method branches at "YES" and enters an instruction "STORE SITUATION DATA" wherein the current situation data is stored in the solution selection module 4 in place of the situation data stored before the change occurred. The method enters an instruction "COMPUTE TIME AVAILABLE FOR ALLOCATION" wherein the amount of time available for computation of the hall call allocation is estimated according to the current situation. The method then enters an instruction "START (CAS) CALL ALLOCATION SUBROUTINE" wherein the hall call allocation procedure is started at a circle "CAS". The method then returns to the instruction "COLLECT AND STORE TRAFFIC MODEL DATA".

The hall call subroutine portion of the method begins at the circle "CAS" and enters an instruction "SELECT FIRST SOLUTION AND SET CURRENT BEST" whereby a first call allocation solution is generated utilizing predetermined conventional rules. The first call allocation is then stored as the current best solution found in the solution selection module 4 and is generated as the probable best call allocation solution to the simulator module 2. The method enters an instruction "READ TRAFFIC MODEL DATA, SIMULATE SOLUTION AND COMPUTE FACTORS" whereby the traffic model data required for the simulation are read (estimation of number of passengers behind a hall call, estimation of passenger arrival times and floors, probability of passenger destinations, etc.). Hereafter movements of cars, doors and passengers are simulated using the first call allocation solution as the probable best call allocation solution. During the simulation, factors associated with passengers, e.g. distribution of waiting times and travel times, or factors associated with cars, e.g. number of door operations and energy consumption, are computed. The method then enters an instruction "READ OPTIMIZATION CRITERIA, EVALUATE THE SOLUTION (APPLY OPTIMIZATION FUNCTION TO FACTORS)" whereby the optimization criteria are read and the probable best solution is evaluated according to selected criteria and factors computed during the simulation by the calculation module 3 to generate the another call allocation solution as an evaluation of the probable best call allocation solution.

The method then enters an instruction "COMPARE SOLUTION WITH CURRENT BEST" wherein a comparison is made by the solution selection module 4 between the another call allocation solution (the evaluation of the probable best call allocation solution) and the evaluation of the current best solution. The method then enters a decision point "BEST?" to check if the another call allocation solution (the probable best call allocation solution being examined) is better than the stored current best call allocation solution. Since the another call allocation solution at the input 4.1 and the current best solution stored in the solution selection module 4 are the same for the first call allocation solution generated, the evaluations are the same and the method branches at "YES" to an instruction "PREDICT FUTURE" wherein the future situation of the cars is estimated in the situation estimate module 5. During the evaluation of subsequent probable best call allocation solutions, if the another call allocation solution is better than the current best call allocation solution, the method branches at "YES" to an instruction "PREDICT FUTURE" wherein the future situation of the cars is estimated. The method enters a decision point "OK?" wherein the future situation data of the cars estimated by the situation estimate module 5 is checked. A future situation (e.g. bunching) may be an unfavorable result or may be acceptable. If the solution is acceptable, the method branches at "YES" to an instruction "REPLACE CURRENT BEST BY SOLUTION" whereby the current best call allocation solution in the solution selection module 4 is replaced by the another call allocation solution (the probable best call allocation solution just evaluated). The method then enters a decision point "IS TIME AVAILABLE ELAPSED?" wherein it is checked if some further time for computation is available prior to generation of the call allocation. If the time available for allocation has elapsed, the method branches at "YES" to an instruction "GENERATE CALL ALLOCATION" whereby the current best call allocation solution is generated as a result of the call allocation subroutine. The method then exits the subroutine at a circle "END OF CAS".

If the probable best call allocation solution being examined is not better than the current best call allocation solution, the method branches from the decision point "BEST?" at "NO" to the decision point "IS TIME AVAILABLE ELAPSED?". Also, if the future situation of the cars is not acceptable, the method branches from the decision point "OK?" at "NO" to the decision point "IS TIME AVAILABLE ELAPSED?". If some time is available for computation, the method branches from the decision point "IS TIME AVAILABLE ELAPSED?" at "NO" and enters an instruction "DETERMINE ANOTHER SOLUTION" wherein the next best one of the possible remaining solutions is selected and generated as the probable best call allocation solution by the solution selection module 4. The method then enters the instruction "READ TRAFFIC MODEL DATA, SIMULATE SOLUTION AND COMPUTE FACTORS" whereby this new probable best call allocation solution is evaluated as described above. The subroutine is run until all possible solutions have been evaluated, or the time available for allocation has elapsed, or the current situation data changes.

The apparatus and the method described above can be used for the assignment of regular hall calls (indicating travel direction only) as well as for the assignment of destination calls (hall calls which indicate the desired destination floor).

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A method for assigning hall calls to cars of an elevator group, the elevator group having an elevator control which generates signals representing optimization criteria data and current situation data for the cars and entered hall calls and responds to call allocation data signals for serving the entered hall calls, comprising the steps of:

a. storing as passenger data a distribution of passengers entering hall calls into an elevator control for a group of elevators, the passenger data representing a probable number of passengers waiting at floors served by the elevators and their probable destination floors, and outputting the passenger data as an output signal;

b. receiving current situation data signals from the elevator control representing a current situation of the elevator cars and entered hall calls;

c. generating a plurality of possible call allocation solutions based on the current situation data signals;

d. generating one of the possible call allocation solutions as a probable best call allocation solution signal and a best call allocation solution signal representing a best call allocation solution;

e. generating a factors data signal based upon the output signal representing the stored passenger data and the probable best call allocation solution signal;

f. receiving optimization criteria data signals from the elevator control representing desired optimization criteria for assigning the entered hall calls;

g. calculating another call allocation solution from the optimization criteria data signals and the factors data signal and generating the another call allocation solution as another call allocation solution signal;

h. checking the another call allocation solution signal against the best call allocation solution signal, storing the probable best call allocation solution as the best call allocation solution when the another call allocation solution signal is better than the best call allocation solution signal and repeating the steps d. through h. for each of the possible call allocation solutions;

i. generating a call allocation data signal to the elevator control for assigning the entered hall calls to the elevator cars according to the best call allocation solution;

j. prior to storing the probable best call allocation solution in the step. h., predicting future situation data for the elevator cars and the entered hall calls from the output data signals and the probable best call allocation solution signal; and k. terminating the probable best call allocation solution signal if the future situation data indicates that an unfavorable allocation of the entered hall calls would result.

2. The method according to claim 1 wherein in response to a change in the current situation data signals, the method is terminated and restarted at the step b.

3. The method according to claim 1 including the steps of:

l. prior to the step c., determining the time available for assigning the hall calls to the cars; and m. performing the step i. when time available has elapsed.

4. A method for assigning hall calls to cars of an elevator group, the elevator group having an elevator control which generates signals representing optimization criteria data and situation data for the cars and entered hall calls and responds to call allocation data signals for serving the entered hall calls, comprising the steps of:

a. storing as passenger data a distribution of passengers entering hall calls into an elevator control for a group of elevators, the passenger data representing a probable number of passengers waiting at floors served by the elevators and their probable destination floors, and outputting the passenger data as an output signal;

b. receiving current situation data signals from the elevator control representing a current situation of the elevator cars and entered hall calls;

c. generating a first possible call allocation solution based on the current situation data signals as a probable best call allocation solution signal and as a best call allocation solution signal representing a best call allocation solution;

d. generating a factors data signal based upon the output signal representing the stored passenger data and the probable best call allocation solution signal;

e. receiving optimization criteria data signals from the elevator control representing desired optimization criteria for assigning the entered hall calls;

f. calculating another call allocation solution from the optimization criteria data signals and the factors data signal and generating the another call allocation solution as another call allocation solution signal;

g. checking the another call allocation solution signal against the best call allocation solution signal, predicting future situation data for the elevator cars and the entered hall calls from the output data signals and the probable best call allocation solution signal when the another call allocation solution signal is better than the best call allocation solution signal, and storing the probable best call allocation solution as the best call allocation solution when the future situation data indicates that an unfavorable allocation of the entered hall calls would not result;

h. generating another possible call allocation solution based on the current situation data signals as the probable best call allocation signal and repeating the steps d. through h.; and i. generating a call allocation data signal to the elevator control for assigning the entered hall calls to the elevator cars according to the best call allocation solution when the steps d. through g. have been performed on all possible call allocation solutions.

5. The method according to claim 4 wherein in response to a change in the current situation data signals, the method is terminated and restarted at the step b.

6. The method according to claim 4 wherein the step c. is performed by generating the first possible call allocation solution according to a predetermined set of conventional rules.

7. The method according to claim 6 wherein the step c. is performed by generating the first possible call allocation solution according to a predetermined set of conventional rules and the step h. is performed by generating the another possible call allocation solutions utilizing "alpha pruning".

8. The method according to claim 1 wherein the factors data signal includes data for factors which are related to components of the elevator group.

9. An apparatus for assigning hall calls to cars of an elevator group, the elevator group having an elevator control which generates signals representing optimization criteria data and current situation data for the cars and entered hall calls and responds to call allocation data signals for serving the entered hall calls, comprising:

a traffic model module for storing as passenger data a distribution of passengers entering hall calls into an elevator control for a group of elevators, said passenger data representing a probable number of passengers waiting at floors served by the elevators and their probable destination floors, and having an output for generating an output signal representing said passenger data;

a simulator module having a first input connected to said traffic model module output for receiving said output signal, a second input for receiving a probable best call allocation solution signal and a first output, said simulator module being responsive to said traffic model module output signal and said probable best call allocation solution signal for generating a factors data signal at said simulator module first output representing factors related to said passenger data;

a calculation module having a first input connected to said simulator module first output, a second input for receiving optimization criteria as optimization criteria data signals generated by the elevator control and an output, said calculation module being responsive to said factors data signal and said optimization criteria data signals for generating another call allocation solution signal at said calculation module output according to the optimization criteria; and a solution selection module having a first input connected to said calculation module output, a second input for receiving current situation data signals from the elevator control representing a current situation of entered hall calls and elevator cars related to the elevator control, a first output connected to said simulator module second input and a second output for generating a best call allocation solution as a call allocation data signal to the elevator control, said solution selection module being responsive to said current situation data signals for generating a plurality of possible call allocation solutions, for storing said best call allocation solution, and for generating one of said possible call allocation solutions as said probable best call allocation solution signal at said solution selection module first output, and being responsive to said another call allocation solution signal for checking said another call allocation solution signal against said best call allocation solution whereby if said another call allocation solution signal is a better call allocation solution for the elevator group, said solution selection module stores said probable call allocation solution as said best call allocation solution, and wherein said solution selection module responds to a change in said current situation data signal by terminating said probable best call allocation solution signal and responds to said terminating by calculating a first time possible call allocation solution according to a predetermined set of conventional rules and by generating said probable best call allocation solution signal from said first time possible call allocation solution.

10. The apparatus according to claim 9 wherein said solution selection module generates at least another one of said possible call allocation solutions as said probable best call allocation solution signal at said solution selection module first output after checking said another call allocation solution signal.

11. The apparatus according to claim 9 wherein said simulator module has a second output and said solution selection module has a third input and including a situation estimate module having an input connected to said simulator module second output and an output connected to said solution selection module third input, said simulator module generating said output signal and said probable best call allocation solution signal at said simulator module second output, said situation estimate module being responsive to said output signal and said probable best call allocation signal for generating a future situation signal at said situation estimate module output, said solution selection module being responsive to said future situation signal for generating said best call allocation solution as said call allocation data signal.

12. The apparatus according to claim 9 wherein said factors data signal includes data for factors which are related to components of the elevator group.

13. The apparatus according to claim 9 wherein said solution selection module generates said possible call allocation solutions by calculating a first time possible call allocation solution according to a predetermined set of conventional rules and by calculating at least another one of said possible call allocation solution utilizing "alpha pruning".

* * * * *